US007634831B2

(12) United States Patent
Stockbridge et al.

(10) Patent No.: US 7,634,831 B2
(45) Date of Patent: Dec. 22, 2009

(54) FOOTWEAR PRODUCTS, METHODS FOR MAKING FOOTWEAR PRODUCTS, AND STRUCTURES USED IN MAKING FOOTWEAR PRODUCTS

(75) Inventors: Kurt Joseph Stockbridge, Lake Oswego, OR (US); Peter Savage, Warrandyte (AU); Sean Michael McDowell, Portland, OR (US); Sung Yuan Lee, Lu-Kang (TW); Shih-Chang Huang, Tainan (TW); Tien-Yuan Huang, Si-Hu (TW)

(73) Assignee: NIKE, Inc., Beaverton, OR (US)

( * ) Notice: Subject to any disclaimer, the term of this patent is extended or adjusted under 35 U.S.C. 154(b) by 500 days.

(21) Appl. No.: 11/142,674

(22) Filed: Jun. 2, 2005

(65) Prior Publication Data

US 2006/0059713 A1 Mar. 23, 2006

Related U.S. Application Data

(60) Provisional application No. 60/651,495, filed on Jun. 4, 2004.

(51) Int. Cl.
*A43D 25/00* (2006.01)
*A43D 25/18* (2006.01)
*A43D 19/00* (2006.01)

(52) U.S. Cl. ..... 12/142 F; 12/142 T; 36/12; 36/19.5

(58) Field of Classification Search ..... 12/145, 12/142 F, 142 T; 36/16, 46.5, DIG. 1, 44, 36/43, 30 R, 58.5, 12, 19.5
See application file for complete search history.

(56) References Cited

U.S. PATENT DOCUMENTS

| | | | | | |
|---|---|---|---|---|---|
| 2,563,100 | A | * | 8/1951 | Chandler | 12/142 F |
| 3,247,536 | A | * | 4/1966 | Rossitto et al. | 12/142 F |
| 4,098,632 | A | * | 7/1978 | Sprague, Jr. | 156/295 |
| 4,420,894 | A | * | 12/1983 | Glassman | 36/12 |
| 4,597,125 | A | * | 7/1986 | Jones, Jr. | 12/142 F |
| 4,742,625 | A | * | 5/1988 | Sydor et al. | 36/3 R |

(Continued)

FOREIGN PATENT DOCUMENTS

EP 1 308 103 A2 5/2003

(Continued)

OTHER PUBLICATIONS

International Search Report dated Mar. 31, 2006.

*Primary Examiner*—Jila M Mohandesi
(74) *Attorney, Agent, or Firm*—Banner & Witcoff, Ltd.

(57) ABSTRACT

Methods for making footwear products include: (a) applying cement to a surface of an upper and/or midsole; (b) cooling the upper and/or midsole so that these parts will move relative to one another despite the cement's presence; and (c) placing the midsole in the upper. Additional methods include: (a) providing an upper having an interior chamber; (b) placing a prelast member including a midsole allowance part into the chamber; (c) removing the prelast member; and (d) placing a midsole in the chamber. The upper and/or midsole may have cement applied thereto and may be cooled before the insertion step, as described above. When sufficiently cooled, the cement will not immediately bind the parts contacting it, but it will allow relative movement of these parts. After the midsole is positioned in the upper, the assembly may be heated to activate the cement and fix the parts together.

42 Claims, 13 Drawing Sheets

U.S. PATENT DOCUMENTS

| | | | | |
|---|---|---|---|---|
| 4,760,654 | A * | 8/1988 | Limbach | 36/117.5 |
| 5,345,638 | A | 9/1994 | Nishida | |
| 6,226,897 | B1 | 5/2001 | Sand | |
| 6,823,551 | B2 * | 11/2004 | Keidel et al. | 12/142 F |
| 2004/0139629 | A1 * | 7/2004 | Wiener | 36/12 |

FOREIGN PATENT DOCUMENTS

| | | | |
|---|---|---|---|
| JP | HEI 91997-28412 | | 2/1997 |
| WO | WO 01/82732 | A1 | 11/2001 |
| WO | WO 2004/008899 | A1 | 1/2004 |

* cited by examiner

FOOTWEAR PRODUCTS, METHODS FOR MAKING FOOTWEAR PRODUCTS, AND STRUCTURES USED IN MAKING FOOTWEAR PRODUCTS

RELATED APPLICATION DATA

This application claims priority benefits based on U.S. Provisional Patent Application Ser. No. 60/651,495 filed Jun. 4, 2004. U.S. patent application Ser. No. 10/860,638was assigned U.S. Provisional Patent Application. No. 60/651,495 in response to a Request to convert this originally non-provisional patent application to a provisional patent application. U.S. patent application Ser. No. 10/860,638 (now U.S. Provisional Patent Application. No. 60/651,495) is entirely incorporated herein by reference.

FIELD OF THE INVENTION

Aspects of the present invention generally relate to footwear products, intermediate structures used in making footwear products, and methods of making footwear products and the intermediate structures. In at least some examples of this invention, the structures will include a midsole member located within an interior chamber defined by the upper member of the footwear structure.

BACKGROUND

Conventional footwear products, and particularly athletic shoes, include an upper member attached to a shoe sole structure. Typically, the upper member will include an internal insole. The shoe sole structure typically includes a midsole and an outsole connected to one another as a single assembly (e.g., using adhesives) that is constructed separate from the upper member. This shoe sole assembly then is attached to the upper member, e.g., using adhesives, stitching, welding, etc.

The use of a conventional external midsole and outsole assembly as described above tends to produce shoe designs having a very pronounced and visually apparent sole structure. Such shoe designs, including a complete upper, midsole, and outsole assembly also tend to have a relatively high weight, which can hamper athletic performance. It would significantly increase the pallet of available designs to provide footwear structures and methods of making these structures that eliminate the need for this pronounced and visually apparent shoe sole structure. Furthermore, eliminating at least a portion of the outsole from the shoe design would help, in at least some instances, reduce the overall weight of the footwear product. Nonetheless, any such designs must remain safe, stable, and comfortable when worn, particularly when the footwear is designed for athletic use.

SUMMARY

Aspects of the present invention relate to structures and methods used in making footwear products. Such structures may include: (a) an upper member having a foot-receiving opening defined therein, wherein the upper member defines an interior chamber and an exterior surface; and (b) a midsole provided in the interior chamber of the upper member and fixed to the upper member, wherein the midsole is located or positioned completely within the interior chamber. Optionally, at least a portion of the exterior surface of the upper member may form at least a portion of an outsole of the structure, and/or the structure may include one or more outsole members and/or one or more heel members attached to at least a portion of the exterior surface of the upper member. In some examples, the outsole and/or heel member(s) may be mounted directly on the exterior surface of the upper member. In at least some examples, the resulting footwear product will be lightweight and particularly suitable for athletic use.

Additional aspects of this invention relate to methods for making various structures, including footwear midsole and upper member assemblies, as well as complete pieces of footwear, e.g., like those described above. Such methods may include, for example: (a) applying a cement material to at least one member selected from the group consisting of: at least a portion of an upper member that will form an interior chamber of the upper member and at least a portion of a midsole that will contact the upper member when the midsole is included in the upper member; (b) cooling at least one of the upper member or the midsole to a sufficient extent so that the midsole and upper member will move with respect to one another despite the presence of the cement material; and (c) placing the midsole in the interior chamber of the upper member in a manner such that at least some of the midsole contacts and moves with respect to at least some of the upper member, despite the presence of the cement material. In at least some examples of the invention, both the upper member and the midsole will have cement material applied thereto, and both members will be cooled.

Other example methods in accordance with this invention may include: (a) providing an upper member, wherein the upper member includes a foot-receiving opening defined therein that provides access to an interior chamber defined by the upper member; (b) placing a prelast member through the opening into the interior chamber, wherein the prelast member includes a midsole allowance part; (c) removing the prelast member and the midsole allowance part from the upper member; and (d) placing a midsole in the interior chamber of the upper member through the opening. The upper member and/or the midsole may have cement applied thereto and may be cooled prior to insertion of the midsole into the upper member, as described above.

As noted above, at least one of the midsole and/or the upper member may have cement material applied to it before the midsole is placed in the upper member, and the midsole and/or upper member (preferably at least the part or parts containing the cement material) may be cooled prior to insertion of the midsole into the upper member. When cooled to a sufficient extent, the cement-containing portion of the midsole will be able to contact and still move with respect to the upper member and/or the cement-containing portion of the upper member despite the presence of the cement material. After the midsole has been placed in the interior chamber of the upper member and the cement material contacts the opposite and adjacent piece of the structure, the combined midsole and upper member assembly may be heated to activate the cement and thereby bond the assembly together.

BRIEF DESCRIPTION OF THE DRAWINGS

The above and other objects, features, and advantages of the present invention will be more readily apparent and more fully understood from the following detailed description, taken in conjunction with the appended drawings, which illustrate example process steps in accordance with examples of the present invention, wherein.

DETAILED DESCRIPTION

Figure 1:
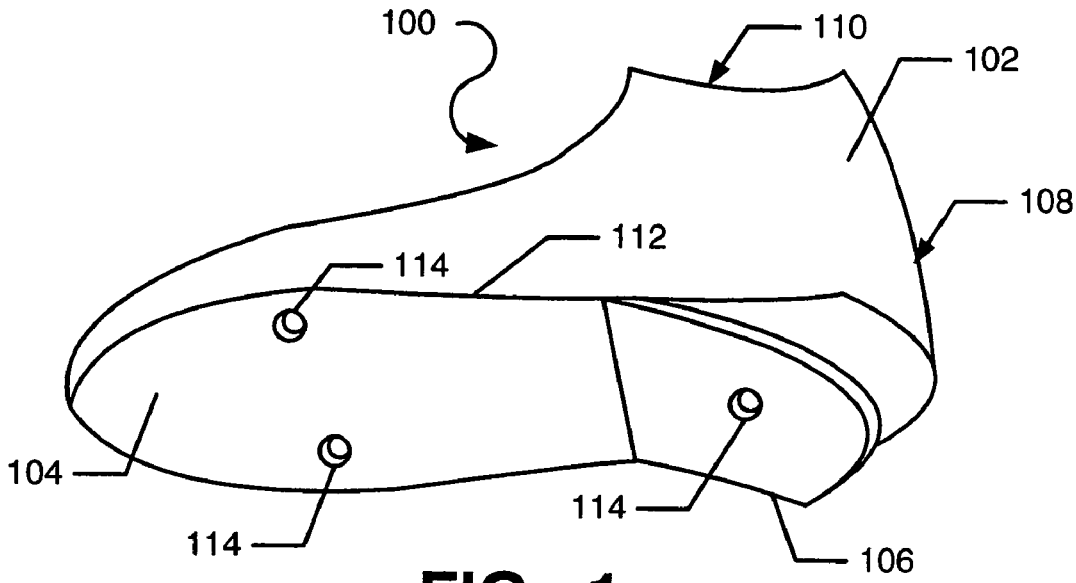
FIG. 1 illustrates an example structure and orientation of an upper member at the start of an example process in accordance with aspects of this invention.

Various specific examples of structures and methods in accordance with this invention are described in detail below in conjunction with the attached drawings. To assist the reader, this specification is divided into various subsections, as follows: Terms; General Description of Aspects of the Invention; Specific Examples of the Invention; and Conclusion.

A. Terms

The following terms are used in this specification, and unless otherwise noted or clear from the context, these terms have the meanings provided below.

"Footwear" means any type of wearing apparel for the feet, and this term includes, but is not limited to: all types of shoes, boots, sneakers, sandals, thongs, flip-flops, mules, scuffs, slippers, athletic shoes, sport-specific shoes (such as golf shoes, ski boots, etc.), and the like.

"Cement material" or "cement" refers to any type of bonding material including conventional materials known in the art. Included within the scope of "cement materials," but not limiting the term, are adhesives, contact cements, primers, and the like. The terms "cement," "cement material," "adhesive," and "adhesive material" are used synonymously and interchangeably in this specification and are to be broadly construed as covering any type of bonding material.

B. General Description of Aspects of the Invention

In general, aspects of this invention relate to structures and methods used in making footwear products, including completed footwear products. More specific example aspects of the invention relate to structures that include: (a) an upper member having a foot-receiving opening defined therein, wherein the upper member defines an interior chamber and an exterior surface; (b) a midsole provided in the interior chamber of the upper member and fixed to the upper member, wherein the midsole is completely within the interior chamber; and (c) an outsole member attached to at least a portion of the exterior surface of the upper member. As another example, structures in accordance with at least some aspects of the present invention may include: (a) an upper member having a foot-receiving opening defined therein, wherein the upper member defines an interior chamber and an exterior surface, and wherein at least a portion of the exterior surface of the upper member forms at least a portion of an outsole of the structure; and (b) a midsole provided in the interior chamber of the upper member and fixed to the upper member, wherein the midsole is located completely within the interior chamber. Example structures of this type further may include one or more outsole members and/or one or more heel units attached to the exterior surface of the upper member.

If desired, structures in accordance with at least some aspects of the present invention further may include midsoles having alignment systems for aligning and/or otherwise properly orienting the midsole with respect to other elements in the structure. For example, midsoles used in structures in accordance with at least some examples of the invention may include at least one projection (and in some examples plural projections) that fit into corresponding recesses or openings defined in another portion of the structure, such as the upper member, the outsole, the insole, and the like. Alternatively, if desired, the midsole may include one or more openings or recesses and another portion of the structure may include projections designed to fit into the openings or recesses.

Additional aspects of this invention relate to methods for making various structures, including footwear midsole and upper member assemblies, as well as complete pieces of footwear. Such methods may include, for example: (a) applying a cement material to at least one member selected from the group consisting of: at least a portion of an upper member that will form an interior chamber of the upper member and at least a portion of a midsole that will contact the upper member when the midsole is included in the upper member; (b) cooling at least one of the upper member or the midsole to a sufficient extent so that the midsole and upper member will move with respect to one another despite the presence of the cement material; and (c) placing the midsole in the interior chamber of the upper member in a manner such that at least some of the midsole contacts and moves with respect to at least some of the upper member despite the presence of the cement material. In at least some examples, both the upper member and the midsole will have cement material applied thereto, and both members will be cooled.

Methods in accordance with examples of the invention may include additional steps. For example, after cooling and placing the midsole in the interior chamber of the upper member, the combined midsole and upper member assembly may be heated to thereby activate the cement material(s) and bond the midsole and upper member together. Additionally, if desired, one or more additional elements may be attached to or included with the midsole and upper member assemblies, such as: outsole members, heel units, closure systems, designs, logos, and the like.

Additional or alternative methods in accordance with examples of the invention may include: (a) providing an upper member, wherein the upper member includes a foot-receiving opening defined therein providing access to an interior chamber defined by the upper member; (b) placing a prelast member through the opening into the interior chamber, wherein the prelast member includes a midsole allowance part; (c) removing the prelast member and the midsole allowance part from the upper member; and (d) placing a midsole in the interior chamber of the upper member through the opening. Additionally, as noted above, if desired, one or more additional elements may be attached to or included with the midsole and upper member assemblies, such as: outsole members, heel units, closure systems, designs, logos, and the like.

At least one of the midsole and/or the upper member may have cement applied to it before the midsole is placed in the upper member, and the midsole and/or upper member (preferably at least the part or parts containing the cement material) may be cooled prior to insertion of the midsole into the upper member. When cooled to a sufficient extent, the cement material will "deactivate" somewhat such that the cement-containing portion of the midsole will be able to contact and still move with respect to the upper member and/or such that the cement-containing portion of the upper member will be able to contact and still move with respect to the midsole despite the presence of the cement. After the midsole has been placed in the interior chamber of the upper member and the cement contacts the opposite and adjacent piece of the structure, the midsole and upper member assembly may be heated to activate the cement and fix the assembly together.

In at least some example methods in accordance with this invention, including at least some of the various examples described above, the midsole may be placed in the interior chamber of the upper member through a foot-receiving opening defined in the upper member (i.e., the same opening through which a user will insert his/her foot in the finished footwear product). In such examples, the foot-receiving opening may be the only opening provided in the upper member that is capable of receiving the midsole at the time the midsole is placed in the interior chamber (i.e., it may be the only opening in the upper member large enough to allow entry of the midsole into the interior chamber). In at least some examples, a heel portion of the upper member may be closed prior to placing the midsole in the interior chamber of the upper member (e.g., by sewing, adhesives, another fastening means, or in some other manner).

Furthermore, methods in accordance with at least some examples of the invention may include fitting the midsole into the upper member in a predetermined orientation. This may include, for example, use of an alignment aid to assure that the midsole is properly aligned and oriented with respect to one or more other elements in the structure. As noted above, the alignment aid may include one or more projections provided on the midsole that fit into corresponding projection-receiving recesses and/or openings defined in the upper member, in the outsole, in the insole, and/or in some other element of the structure. Alternatively, if desired, the midsole may include the recess(es) or opening(s) and the corresponding projection(s) may be provided on another part of the structure, such as the upper member, the outsole, the insole, etc. In some instances, at least part of the alignment aid and/or an indicator of the correct alignment may be visible from the exterior of the assembly. Other suitable alignment aids or fitting aids are possible and may be used without departing from the invention.

Still additional steps may be included in various methods according to examples of this invention. For example, once the midsole is placed in the interior chamber, a last member may be inserted through the foot-receiving opening into the interior chamber of the upper member, and then this entire assembly may be heated to help form and set the assembly to the desired size and shape. Before, during, and/or after this heating, the assembly may be pressed together, under high pressure, to further bond the structure together.

Aspects of this invention also relate to the midsole and upper member assemblies produced by the various methods described above, as well as to pieces of footwear including these assemblies and/or produced by the methods described above.

Specific examples of the invention are described in more detail below. The reader should understand that these specific examples are set forth merely to illustrate examples of the invention, and they should not be construed as limiting the invention.

C. Specific Examples of the Invention

The figures in this application illustrate various examples of steps useful in example methods in accordance with this invention. When the same reference number appears in more than one figure, that reference number is used consistently in this specification and the figures to refer to the same part or element throughout.

Step 1—Begin

The method in accordance with the illustrated example of the invention begins with a footwear upper member that has very generally been formed into the shape as it will appear in the finished piece of footwear. In the illustrated example, as shown in FIG. 1, the upper member 100 includes a sidewall 102, optionally of a continuous, one-piece construction; that is attached to a base member 104. The upper member sidewall 102 may be attached to the upper's base member 104 in any suitable or desired manner without departing from the invention. For example, these elements may be joined to one another by sewing, by adhesives, by other connectors, and the like. As still another example, the upper's sidewall 102 and the base member 104 may be formed from a single piece of material, without departing from the invention.

Any suitable or desired material may be used for the upper member sidewall 102 and/or base member 104 without departing from the invention, including conventional materials used and well known in the art, such as conventional natural or synthetic materials and/or combinations thereof. In at least some examples, the portions of the sidewalls 102 and/or the base member 104 that will eventually contact the foot of the wearer may include fabric, foam, and/or cushioning materials, to increase the comfort and/or improve the feel of the upper member 100 on the wearer's foot. The fabric, foam, and/or cushioning materials may be any suitable or desired materials without departing from the invention, including conventional materials known in the art. For example, the base member 104 may include a conventional insole as at least part of its construction. Additionally, the fabric, foam, and/or cushioning materials may be attached to and/or included as part of the structural components of the upper member 100 in any suitable or desired manner without departing from the invention, including in conventional manners known in the art.

FIG. 1 illustrates an unattached flap 106 of strobel material in the base member 104 at the heel area 108 of the upper member 100. This unattached flap 106 allows access to the portions of the upper member 100 inside the sidewalls, for reasons described in more detail below. A conventional foot-receiving opening 110 also is provided in the upper member 100, as shown in FIG. 1. The base member 104, including the flap portion 106, further may include one or more openings 114 defined therein. The purpose of these openings will be described in more detail below.

As this example process begins, one or more upper members 100 (in some examples, corresponding pairs of upper members) are placed inside-out at the beginning of an assembly line for an assembly process in accordance with one example of the invention. Accordingly, in the illustrated example, the exterior surface illustrated in FIG. 1 actually constitutes the interior surface of the final footwear product (and it may be comprised of fabric, foam, and/or other cushioning material, as described above), while the interior surface constitutes the exterior of the final footwear product.

Step 2—Cementing the Upper Sidewall and Insole

Figure 2:
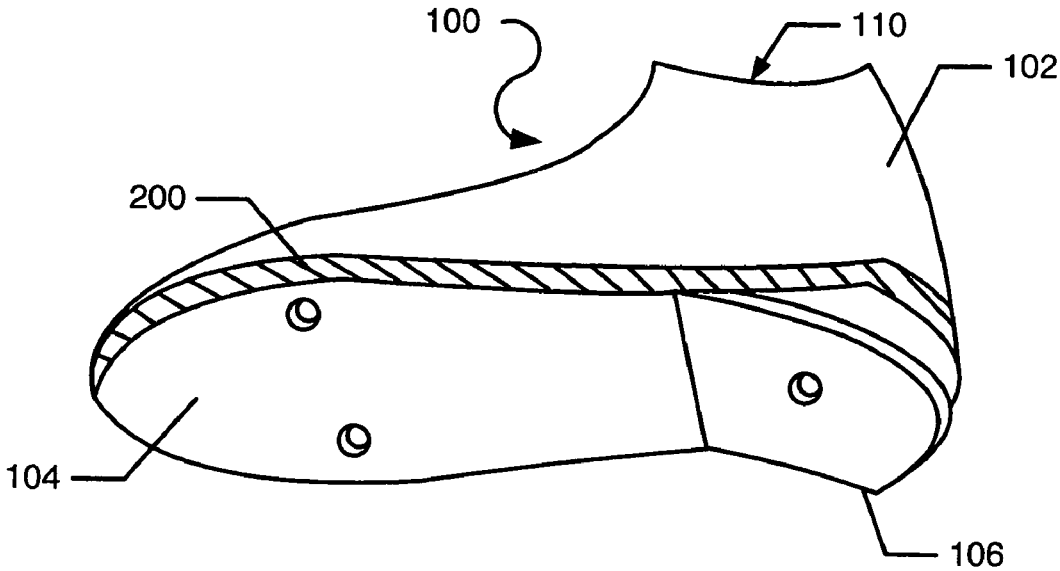
FIG. 2 illustrates application of an adhesive material to the upper member in an example process in accordance with aspects of this invention.

As an initial step in this example process, as illustrated in FIG. 2, a cement material 200 is applied to at least a portion of what will become the interior surface of the upper member 100 (notably, in FIG. 2, the interior surface of the upper member 100 is on the outside because the upper member 100 is inside-out).

In the illustrated example, the cement material 200 is applied to a lower portion of the sidewall 102 and/or at an insole area (e.g., along base member 104) of the inside-out upper member 100. The area to which the cement material 200 is applied in this example is shown in hatching in FIG. 2.

The cement material 200 will enable the footwear's midsole, which will be inserted into the upper member 100 later in the process, to stay in place within the final footwear assembly. If this cement material 200 were not applied, the midsole may be able to slide around inside the upper member 100, causing an unstable or insecure fit, potentially damaging the footwear assembly, causing injury to the wearer, and/or providing an uncomfortable fit. Any suitable or desired type of cement material 200 may be used without departing from the invention, including conventional cement materials known to those in the art and commercially available.

Step 3—Heating the Cement—Containing Upper Assembly

Figure 3:
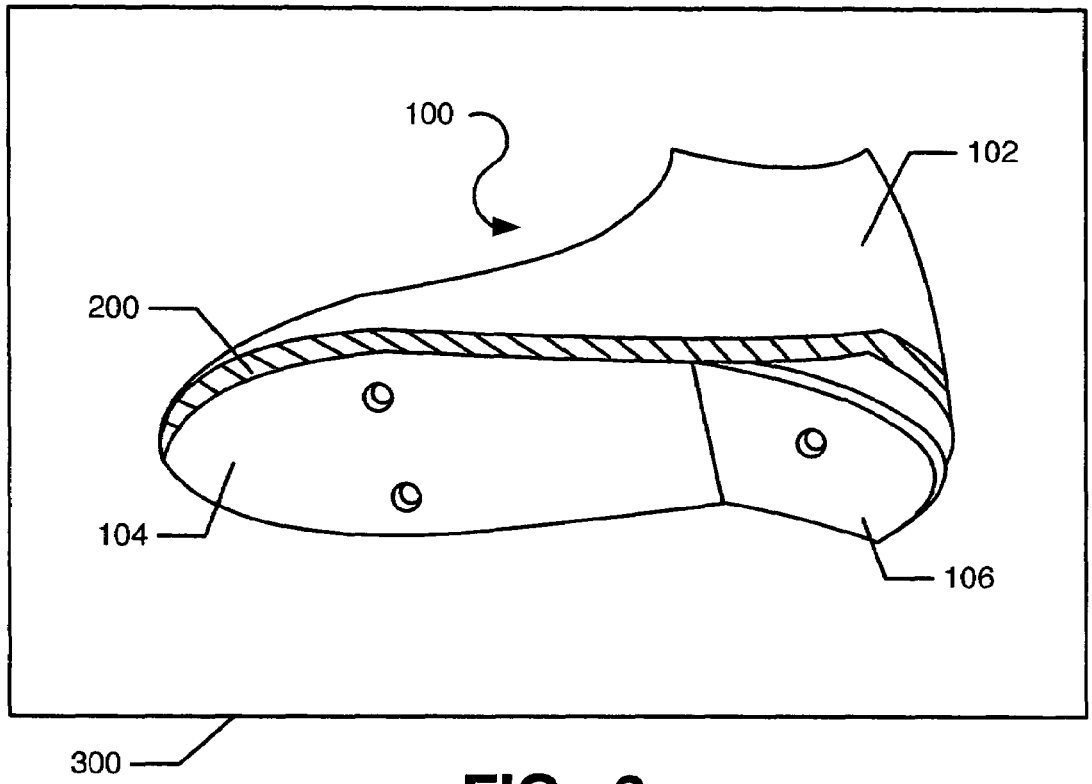
FIG. 3 illustrates an example upper member heating step in an example process in accordance with aspects of this invention.

Once the cement material 200 has been applied to the sidewall 102 and/or insole area of the upper member 100, the upper member 100 may be heated to dry the cement material 200, if necessary. As illustrated in FIG. 3, the upper member 100 (with the applied cement material 200) is dried, e.g., in a heating tunnel, oven, or other appropriate heating device (generally designated as a heating unit 300). Of course, any suitable or desired heating conditions may be used without departing from the invention, for example, based on the type of cement, the type of upper material, the amount of cement applied, the humidity, the type of midsole material, the type of cement used on the midsole, other ambient conditions, etc. In the illustrated example, the upper member 100 is dried at about 50° C. to 55° C. for about two to three minutes. Of course, if desired, no heating may be required and the cement material 200 may be allowed to dry, if necessary, under ambient conditions.

Although not illustrated in these figures, the same or a different type of cement material also may be applied to a separate midsole member and/or dried in the same manner described above with respect to the upper member 100. If desired, the midsole member may be cemented and/or dried in parallel along with the upper member 100, optionally drying the midsole member at the same time and under the same conditions as the upper member 100, without departing from the invention. The midsole member will be described in more detail below.

Step 4—Turning the Upper Member Outside-Out

Figure 4:
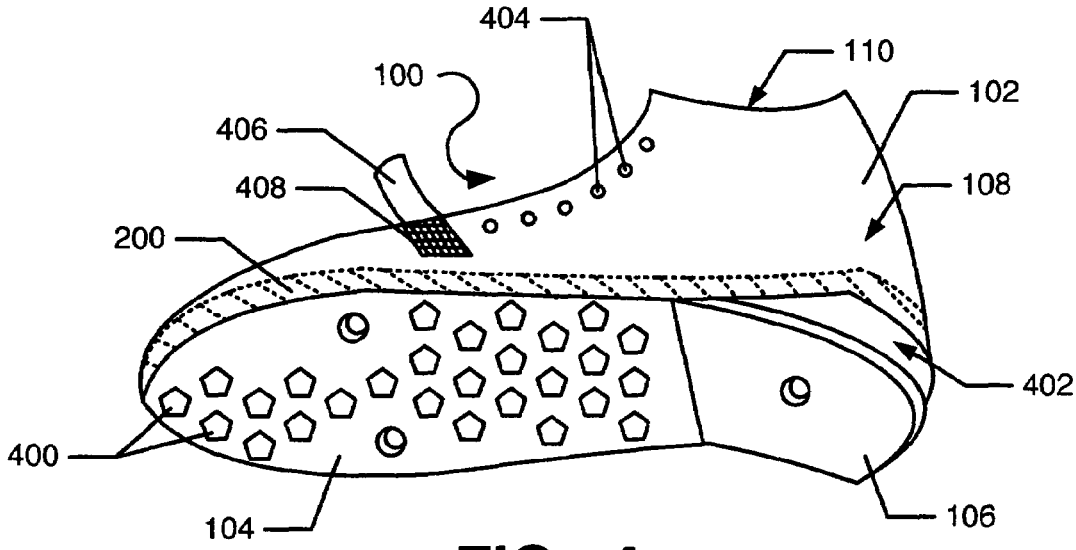
FIG. 4 illustrates an example structure and orientation of an upper member when turned outside-out during an example process in accordance with aspects of this invention.

After the drying step, if any, the upper member 100 orientation is reversed so that the outside of the upper member 100 is located on the exterior of the overall assembly (i.e., "outside-out"). As illustrated in FIG. 4, the upper member 100 includes exterior sidewalls 102 made of any suitable or desired materials, as described above. Additionally, because the cement material 200 is now located inside the upper member 100, the cement material 200 is shown in broken lines in FIG. 4.

The exterior surface of the upper's base member 104 also now is exposed. As illustrated in FIG. 4, in at least some examples of upper members 100 in accordance with the invention, the base member 104 may include traction elements 400 such that at least some portion of the base member 104 may function as an outsole in the finished piece of footwear. Any suitable or desired traction elements 400 or tread design may be included as part of the base member 104, if desired, without departing from the invention. Of course, if desired, in at least some examples of the invention, one or more separate outsole elements may be used rather than using at least a portion of the upper member 100 has an outsole. As another alternative, traction elements 400 may be applied to the base member 104 exterior surface at any desired time (e.g., using adhesives), including after the upper member 100 is turned outside-out.

At this point in the illustrated process, the flap member 106 remains unattached and allows access into the interior chamber 402 of the upper member 100 through the heel area 108 of the upper member 100. Additionally, the foot-receiving opening 110 also allows access to the interior chamber 402. The walls within the interior chamber 402 (which were on the outside in the steps illustrated in FIGS. 1-3) may include fabric, foam, and/or other cushioning or comfort elements, as described above.

The example footwear upper member 100 structure illustrated in FIG. 4 includes two independent closure systems. First, the upper member 100 includes eyelets 404 for receiving a shoe lace in a conventional manner known in the art. Additionally, this example upper member 100 includes a closure system comprised of a closure flap or strap 406 that engages a closure element 408 mounted on and/or integrally formed as part of the upper member 100. The closure flap 406 and closure element 408 may attach to and/or otherwise engage one another in any suitable or desired manner without departing from the invention, for example, using one or more snaps, hooks, buckles, hook-and-loop type fasteners, hook-and-eyelet type fasteners, adhesives, etc. Of course, any suitable or desired footwear closure system and/or combination of systems may be used without departing from the invention, including conventional closure systems known in the art.

Step 5—Flattening any Internal Seams or Flanges

Figure 5:
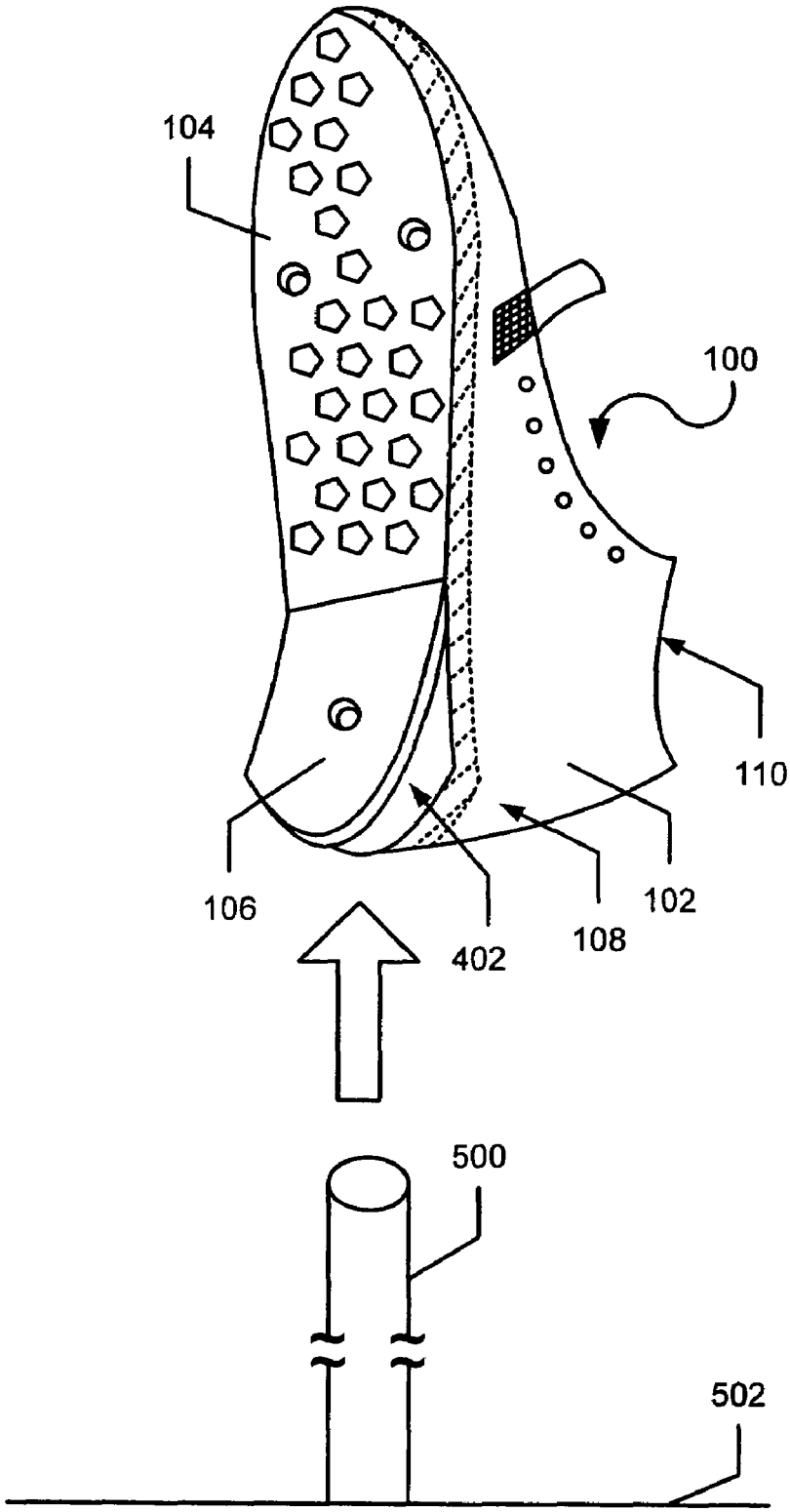
FIG. 5 illustrates an example step of flattening or smoothing an internal seam or flange of an upper member during an example process in accordance with aspects of this invention.

As illustrated in FIG. 5, the interior chamber 402 of the upper member 100 may include one or more sewn seams, weld seams, or other flanges, e.g., locations where various pieces of the upper member are joined together to form the overall upper structure, for example, along the edges 112 where the sidewalls 102 are secured to the base member 104, etc. (see FIG. 1). These seams or flanges can become even more pronounced when the upper member 100 is turned outside-out as described above in conjunction with FIG. 4. Often, these seams or flanges, if left untreated, will interfere with insertion of the midsole when the time comes during the assembly process to insert the midsole into the upper member 100.

Accordingly, in this step, any seams or flanges within the interior chamber 402 of the upper member 100, particularly any located along the upper member 100 bottom or side edges (e.g., at or near the contact cement-containing areas 200), may be flatten or smoothed to allow for smoother and easier insertion of the midsole into the interior chamber 402. Any suitable or desired manner of flattening or smoothing the seams or flanges may be used without departing from the invention. For example, as illustrated in FIG. 5, the seams or flanges may be flattened or smoothed by pressing them against a smooth post 500 mounted on a table 502. Optionally, if desired, the smoothing element 500 may be a heated metal post or other metal member, optionally capable of applying water or steam (akin to a conventional iron). The smoothing element, such as post 500, may enter the interior chamber 402 through the opening in the heel area 108 provided by the flap member 106. Of course, if desired, the smoothing element may be constructed and shaped to enter the interior chamber 402 through the foot-receiving opening 110. Any suitable or desired smoothing element, smoothing element shape, or smoothing element configuration may be used without departing from this invention.

Step 6—Activating the Heel Counter

Figure 6:
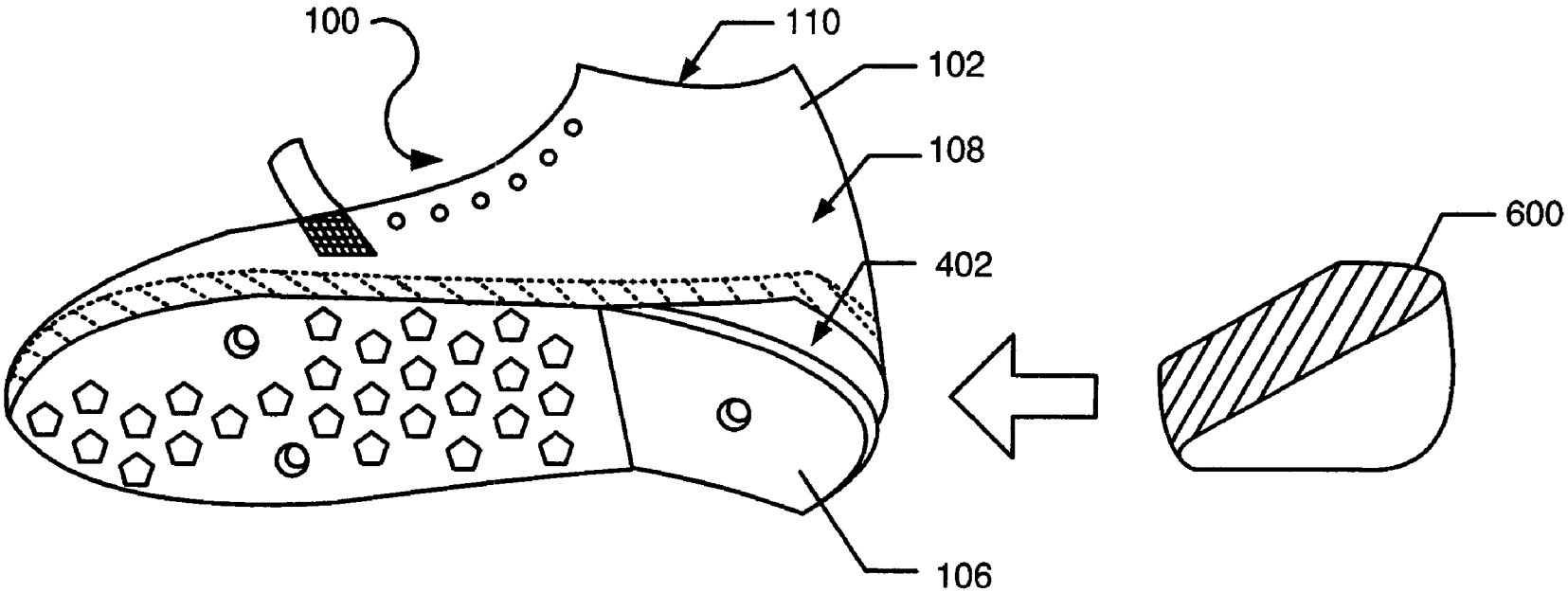
FIG. 6 illustrates an example step of activating a heel counter of an upper member during an example process in accordance with aspects of this invention.

In a next example process step, the heel area 108 of the upper member 100 (also called a "heel counter") is molded and shaped, under heating. "Heel counter activation" and shaping processes of this type are conventional and known in the art. For example, as illustrated in FIG. 6, a heel counter shaping mold 600 may be inserted into the interior chamber 402 of the upper member 100 through the opening defined by the flap member 106 in the heel area 108. Optionally, if necessary or desired, additional heel structural elements for the upper member 100 may be placed in the interior chamber 402 and/or included with the upper member sidewall 102 at some point in the upper member 100 construction process. The heel counter shaping mold 600 may be used to apply heat to the heel counter area 108, if necessary, and/or to provide a final desired shape for this area 108. Also, if desired, the heel counter shaping mold 600 may be inserted into the interior chamber 402 through the foot-receiving opening 110, without departing from the invention.

Any suitable or desired counter heating and/or activation conditions may be used without departing from the invention, depending, for example, on the materials used in making the various components of the upper member 100, ambient temperature and humidity conditions, amount of shape changes needed in the heel area 108, additional structural elements included in the heel area 108, and the like. As one more specific example, in the illustrated process, the heel counter is activated at a temperature in the range from about 85° C. to 95° C. for about one minute. Optionally or alternatively, if desired, pressure also may be applied to the heel counter area 108 to further shape the heel counter area 108 to match the heel counter shaping mold 600.

Step 7—Molding the Backpart of the Upper Member

Figure 7:
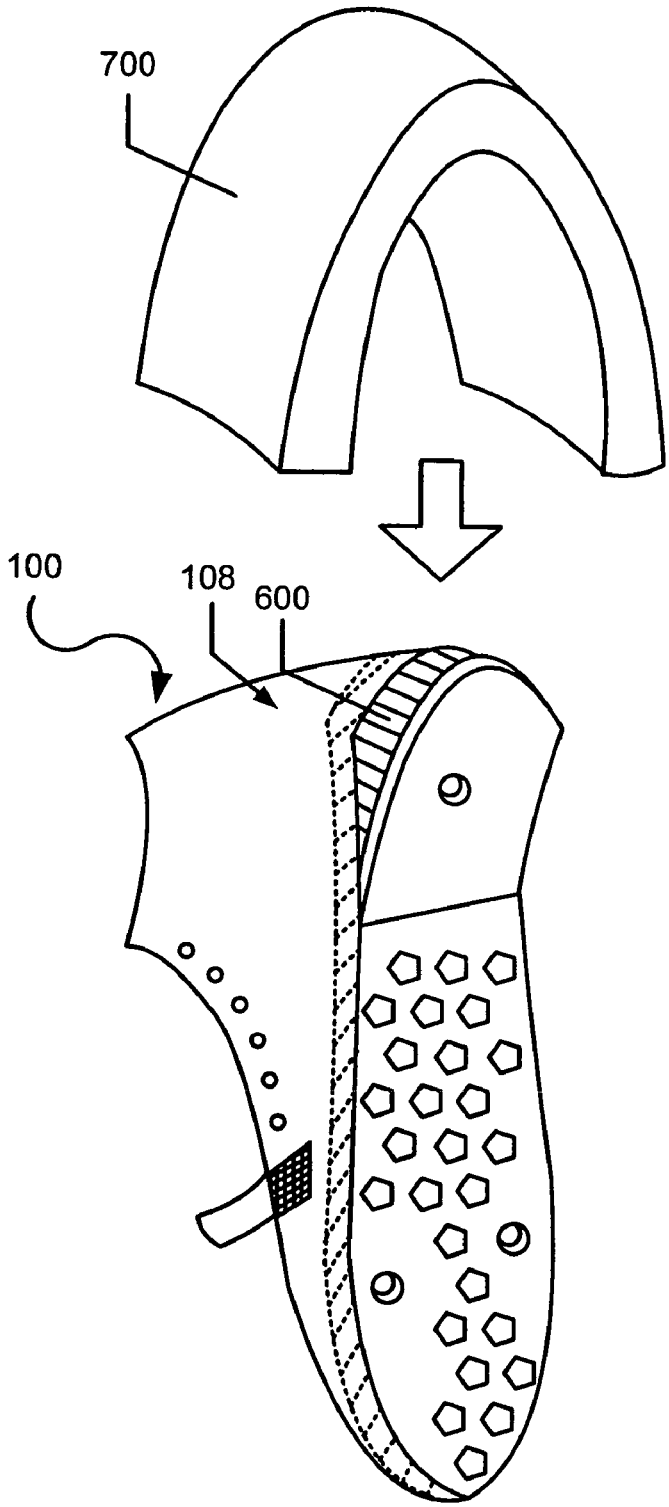
FIG. 7 illustrates an example step of molding the heel area of an upper member during an example process in accordance with aspects of this invention.

After the heel counter activation and (optional) shaping processes, the upper member 100, and particularly the heel counter area 108 of the upper member 100, are placed in a chilled or cooled mold 700 and pressed to further form and shape the exterior and/or interior of the heel area 108 of the upper member 100, as shown in FIG. 7. If desired, the heel counter shaping mold 600 may remain in the interior chamber 402, or alternatively, another mold member may be placed therein, to help shape and set the interior portions of the heel area 108.

Any suitable or desired temperature, pressure, and/or timing conditions can be used for molding the heel area 108 of the upper member 100 without departing from the invention. For example, the mold surface temperature may be less than or equal to about 50° C. in some examples. In the particular example illustrated in conjunction with FIG. 7, the heel area 108 of the upper member 100 may be pressed between mold parts 600 and 700, wherein the surface temperature of at least some of these mold parts 600 and/or 700 is cooled to within the range of about −5° C. to 5° C., for about 25 to 35 seconds under a pressure of about 4 to 5 kg/cm$^2$. Use of these chilled or cooled mold parts 600 and/or 700 allows the materials in the heel area 108 to thermoset, thereby providing the final desired heel shape for the upper member 100.

Step 8—Attaching the Strobel at the Heel Area

At this stage in the process, as described above, the heel area 108 of the upper member 100 includes the unattached flap of material 106. This flap 106 of material (also called a "strobel") was left unattached, as described above, to enable insertion of certain equipment and to allow operation of various pieces of machinery used in the production process. For example, as illustrated in FIG. 5, the smoothing element 500 passed through the opening at the heel area 108 to enable seam and/or flange flattening. Also, the flap 106 of material at the heel area 108 enables insertion of mold member 600 and proper molding of the heel area 108 during the counter activation and backpart molding steps described above in conjunction with FIGS. 6 and 7 (e.g., if the flap 106 were not left unattached, in at least some instances, undesired bunching, stressing, or tearing could occur during the smoothing, activation, and/or molding steps as pieces of equipment are inserted through the foot-receiving opening 110).

Figure 8:
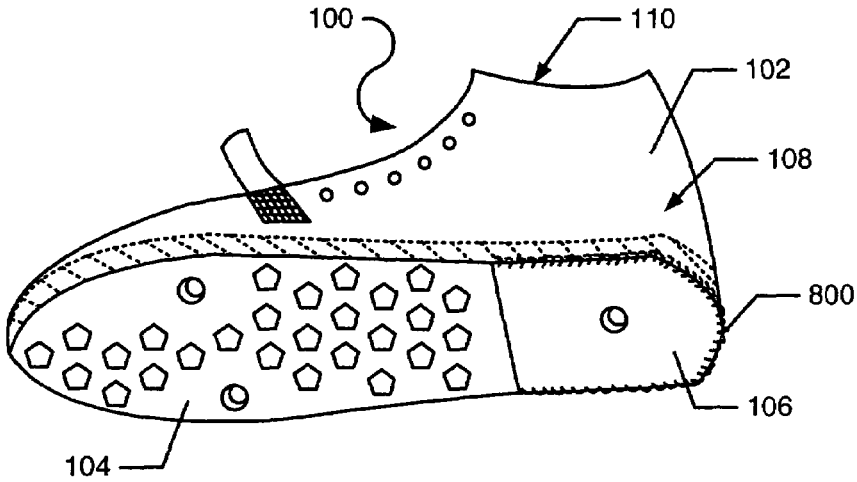
FIG. 8 illustrates an example step of attaching a strobel flap to the remainder of an upper member structure during an example process in accordance with aspects of this invention.

Accordingly, in this step of the example process, the loose flap of material 106 is attached to the remainder of the upper member 100 (e.g., attached to the sidewall 102) to make the upper member 100 of an integral construction. The flap 106 in this example forms a continuous single piece with the remainder of the base member 104. Of course, any suitable manner of attaching the flap 106 to the remainder of the upper member 100 structure may be used without departing from the invention. While sewing or stitching is used as the attachment means 800 in the example illustrated in FIG. 8, those skilled in the art recognize that other attachment means, such as adhesives, welding, mechanical fasteners, additional intermediate materials, and the like may be used to attach the flap 106 to the upper member 100 sidewalls 102 without departing from the invention. Alternatively, if desired, no flap need be provided such that the entire heel area 108 remains open to the interior chamber 402, and this open area may be closed during this step of the process by attaching an independent element to the sidewalls 102 and base member 104.

Step 9—Activating the Toe Box

Figure 9:
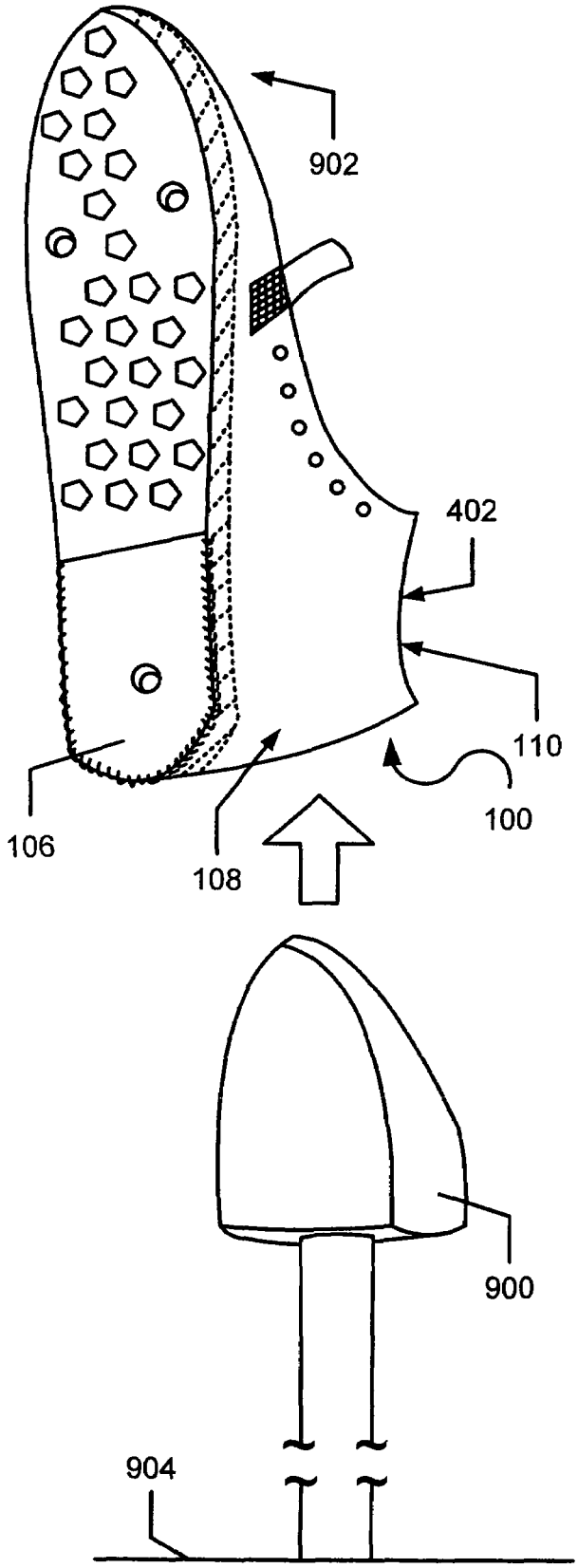
FIG. 9 illustrates an example step of activating a toe box of an upper member during an example process in accordance with aspects of this invention.

In the next step of the example process illustrated in the figures, "toe box activation" occurs. This process is similar to the heel counter activation process described above in conjunction with FIG. 6. Optionally, at some time in the upper construction process, one or more structural elements for the toe box area 902 may have been incorporated into the upper member 100 structure. As illustrated in FIG. 9, a toe box mold 900 (having a final desired shape for the toe area 902 of the upper member 100) then may be inserted into the upper member 100 through the foot-receiving opening 110, which allows access to the interior chamber 402 of the upper member 100. The toe box mold 900 may be mounted to a surface 904, such as a table top as illustrated in FIG. 9. Of course, if desired, this toe box activation step may take place before the heel area 108 is closed as described in conjunction with FIG. 8, and the toe box mold 900 may be inserted into the interior chamber 402 through the opening defined at the unattached flap 106 of the heel area 108.

Any suitable or desired activation conditions may be used without departing from the invention, depending, for example, on the materials used in making the various components of the upper member 100, the presence of any additional structural elements, ambient temperature and humidity conditions, degree of shape changes needed in the toe area 902 of the upper member 100, and the like. As one more specific example, in the illustrated process, the toe box area 902 may be activated at a temperature in the range from about 75° C. to 85° C. for about 8 to 15 seconds. In some examples, the toe box activation conditions may be the same as or similar to those used in activating the heel counter area 108, and vice versa. Optionally, if desired, pressure may be applied to the toe box area 902 to further shape the toe box area 902 to match the mold member 900.

Step 10—Prelasting

Figure 10:
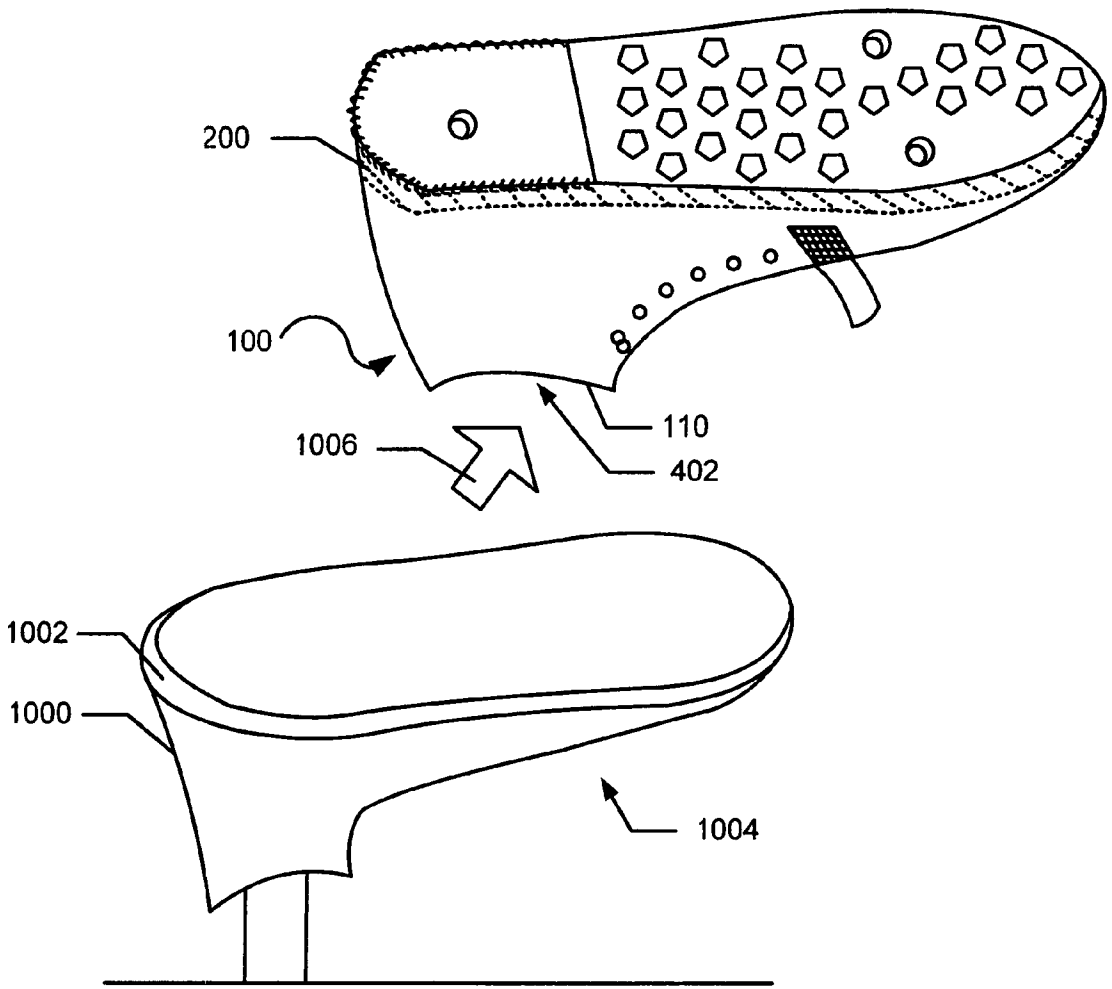
FIG. 10 illustrates an example "prelasting" step during an example process in accordance with aspects of this invention.

At this point in the process, a "prelasting" step occurs. As illustrated in FIG. 10, a last device 1000 is fitted with a midsole allowance part 1002 that mimics the desired size and shape of a midsole to be inserted within the upper member 100 during this initial "prelast" step. The midsole allowance part 1002 is a hard piece of material (e.g., made from shaping mold material) that may be fixed to a last member 1000, as illustrated in FIG. 10, e.g., through screws, clips, binders, or other mechanical connection; through adhesives; and/or in any other suitable or desired manner. As another example, the last member 1000 and midsole allowance part 1002 may be formed as a one piece member without departing from the invention. The combined last member 1000 and midsole allowance part 1002 is called a "prelast member" in this specification and designated as reference number 1004 in FIG. 10.

The prelast member 1004, including the midsole allowance part 1002, is inserted into the upper member 100 through the foot-receiving opening 110, as indicated by arrow 1006 in FIG. 10. The size of the prelast member 1004 during this prelasting step helps to shape the upper member 100 to its final desired size and shape, and it stretches and/or otherwise increases the size of the interior chamber 402 of the upper member 100 to allow for easier insertion of the midsole member.

Step 11—Cooling the Upper Member and the Midsole Member

Figure 11:
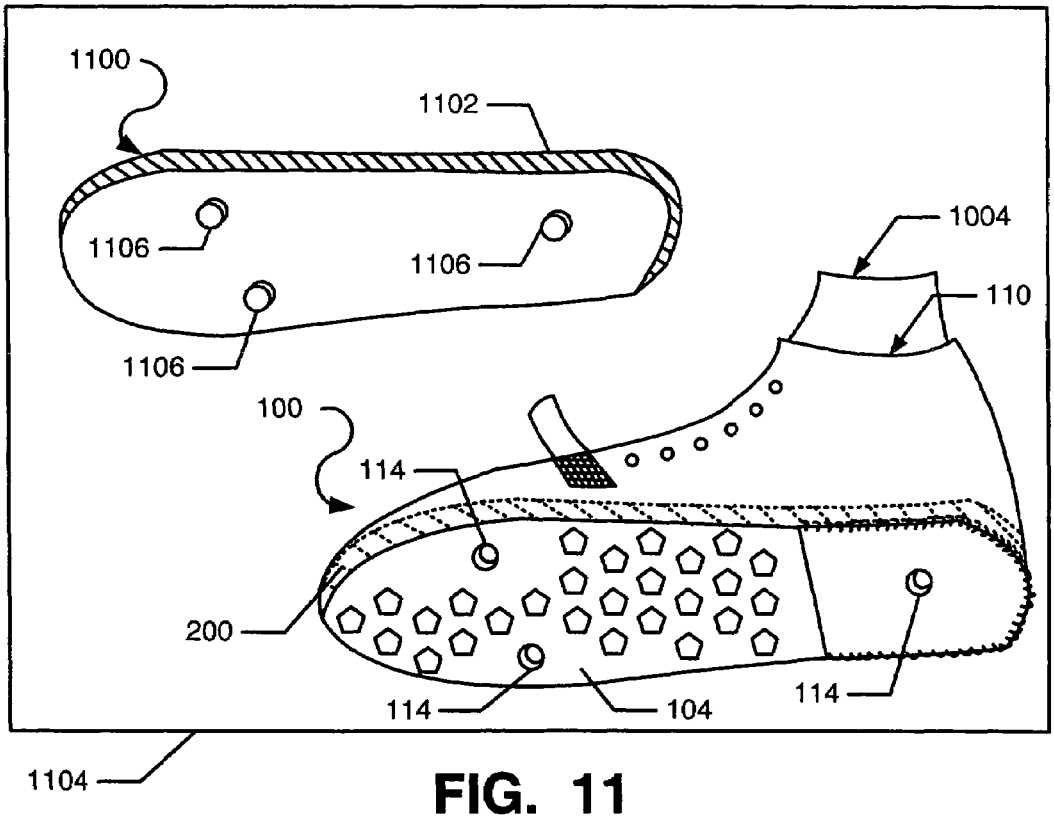
FIG. 11 illustrates an example step of cooling a midsole member and an upper member during an example process in accordance with aspects of this invention.

At this point in the process, as described above, the upper member 100 has been placed on the prelast member 1004 (which includes the midsole allowance part 1002), and the upper member 100 has been cemented and dried (cement material 200 illustrated in FIG. 10 in broken lines), awaiting eventual insertion of a midsole member. Separately and/or concurrently (as described above), a midsole member 1100 may be treated in a similar manner, e.g., it may have a cement material 1102 applied thereto (e.g., along its side edges and/or bottom), and the cement material 1102 may be dried in steps the same as and/or similar to those described above in conjunction with treatment of the upper member 100. Accordingly, in this manner, the midsole member 1100 also is prepared for insertion into an upper member 100. As illustrated in FIG. 11 , the midsole member 1100 may include nubs or projections 1106 on its bottom surface that fit into recesses or openings 114 provided in the base member 104 of the upper member 100. This feature will be described in more detail below.

At this time, as illustrated in FIG. 11, both the upper member 100 (optionally, still on the prelast member 1004 having the midsole allowance part 1002) and the midsole member 1100 are cooled (represented by the cooling zone 1104 illustrated in FIG. 11). The cooling of the upper member 100 around the prelast member 1004 allows the materials of the upper member 100 to thermoset based on the dimensions of the prelast member 1004 (including the midsole allowance part 1002), thereby providing the final desired shape for various portions of the upper member 100. Additionally, the cooling of upper member 100 and the midsole member 1100 allows their respective contact cement materials 200 and 1102, respectively, to deactivate such that these parts will not immediately bind when they touch one another (as parts having contact cement thereon tend to do). In this manner, the upper member 100 and the midsole member 1100 will slide with respect to one another when the midsole member 1100 is finally inserted into the upper member 100. If this cooling process were not performed, in at least some instances, the contact cement 200 on the upper member 100 would tend to stick to the midsole member 1100 as soon as the midsole member 1100 contacted the cement on the upper member 100, and vice versa, thereby resulting in improper insertion of the midsole 1100 into the upper member 100. The cooling process allows some movement of the midsole member 1100 with respect to the upper member 100 before the contact cement on these parts permanently holds them in place with respect to one another.

Any suitable or desired temperature and/or timing conditions can be used to cool the midsole member 1100 and/or the upper member 100 without departing from the invention. For example, the prelast device 1004 surface temperature, the upper member 100 surface temperature, and/or the midsole 1100 surface may be cooled to less than or equal to about 35° C. in some examples. In the particular example process illustrated with respect to the attached figures, the upper member 100 and the midsole member 1100 may be cooled to a temperature within the range of about −5° C. to 5° C. for about 2 to 2½ minutes. While the illustrated example shows the upper member 100 and midsole member 1100 in the same cooling zone 1104 immediately adjacent to one another, those skilled in the art will appreciate that the midsole 1100 and upper member 100 may be separately cooled, optionally in different cooling devices, without departing from the invention. Optionally, if desired, a variety of midsole members 1100 and/or upper members 100 of varying sizes and/or types may be stored in bulk, optionally with contact cement applied thereto and optionally under cooled conditions, ready for the remaining process steps (e.g., the steps described below) without departing from the invention.

FIG. 11 also illustrates the midsole member 1100 as a one-piece element. This is not a requirement of the invention. Rather, if desired, the midsole 1100 may be inserted into an upper member 100 in multiple pieces. The terms "midsole" and "midsole member," as used in this specification, are intended to cover midsole elements composed of one or any other number of pieces.

Step 12—De-Lasting the Upper Member

Figure 12:
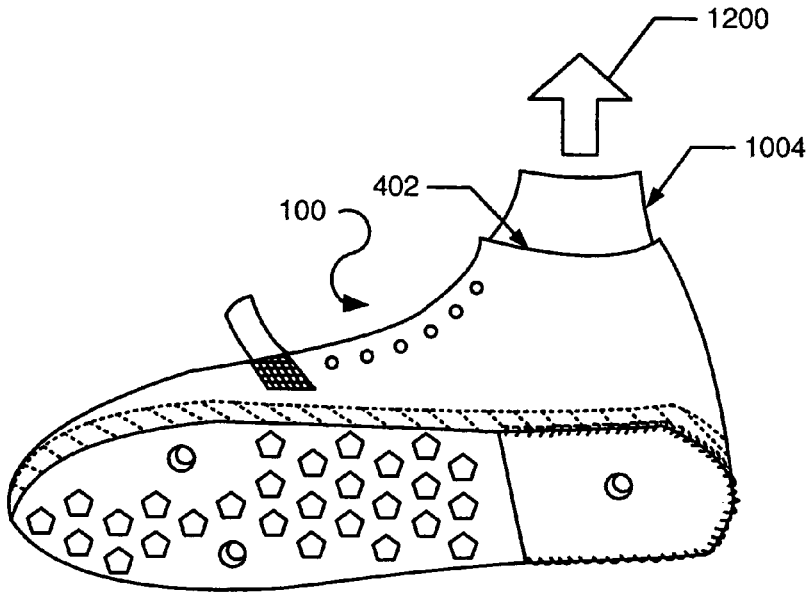
FIG. 12 illustrates an example "de-lasting" step during an example process in accordance with aspects of this invention.

After cooling, the upper member 100 is removed from the prelast member 1004, as shown by arrow 1200 in FIG. 12. When removed, and the midsole allowance part 1102 remains as part of the prelast member 1004 and does not stay within the upper member 100. By this prelasting step, as noted above, the interior chamber 402 of the upper member 100 has been sized to accommodate insertion of a midsole.

Step 13—Inserting the Midsole Member

At this point in the example process, as described above, both the upper member 100 and the midsole member 1100 are in a cooled condition with contact cement 200 and 1102, respectively, applied thereto. Because they are in this cooled condition, as described above, the midsole member 1100 can be slid into the upper member 100 before the contact cement 200 and/or 1102 bonds these parts together.

Figure 13:
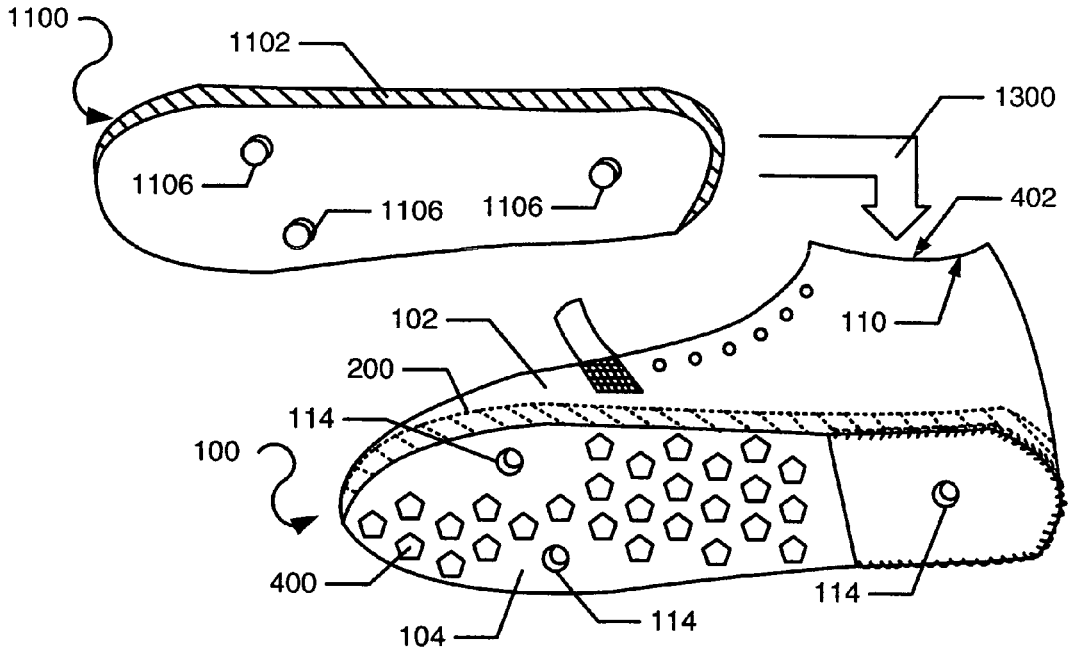
FIG. 13 illustrates an example step of inserting a midsole into an upper member during an example process in accordance with aspects of this invention.

Accordingly, in the next step of the example process, the midsole member 1100 is slid into the interior chamber 402 of the upper member 100 through the foot-receiving opening 110 of upper member 100, as illustrated in FIG. 13 by arrow 1300. Notably, at the time the midsole member 1100 is inserted into the upper member 100 to form a midsole and upper member assembly in this example, the foot-receiving opening 110 is the only opening provided in the upper member 100 that is capable of receiving the midsole member 1100. All other previous openings to the interior chamber 402 have been closed (e.g., during the strobel closing step described above in connection with FIG. 8). The midsole member 1100 is completely included within the interior chamber 402 defined by the upper member (e.g., defined by sidewall 102 and base member 104 of the upper member 100, in this example).

Notably, in this example process, because the upper member 100 is relatively closed during the midsole 1100 insertion procedure (only the foot-receiving opening 110 remains in this example), the insertion process is a relatively "blind" operation, i.e., one cannot easily see whether the midsole member 1100 is properly seated and oriented inside the upper member 100 (e.g., particularly because of the presence of the contact cement 200 and 1102, the midsole member 1100 can become twisted, bunched, and/or otherwise mis-oriented or mis-seated in the upper member 100). Therefore, if desired, in at least some examples of the invention, the midsole member 1100 may include "nubs" or projections 1106 that fit into openings or recesses 114 provided in the upper member 100, the insole (e.g., part of base member 104), and/or some other portion of the footwear structure. The nubs 1106 and openings or recesses 114 may be used as alignment or positioning aids to assure that the midsole member 1100 is proper oriented and seated inside the upper member 100. In at least some examples, the nubs or projections 1106 may be visible through openings 114 defined in the upper member 100, to provide an externally visible indication and confirmation that the midsole member 1100 is properly inserted and oriented. The upper member 100 may include other openings and/or windows therein such that the midsole 1100 may be visible through the upper member structure without departing from the invention.

Other alignment and/or positioning aid arrangements may be used without departing from the invention. For example, if desired, the upper member may include projections or nubs and the midsole member may include openings or recesses for receiving the projections or nubs. Also, each of the midsole and upper members may include both projections and openings (or recesses) that match up with corresponding elements on the other member. As still additional examples, the projections and/or openings (or recesses) may be of any size or shape, provided at any desired location, and/or provided on any desired surface of the midsole and/or upper members without departing from the invention. As still another example, one or more of the traction elements 400 may be formed on the midsole member 1100 and extend through one or more openings provided in the base member 104. If necessary or desired, additional cement or other sealing material may be applied to the projections and/or opening walls to seal the openings 114 in the base member 104 once the projections are inserted therein.

Step 14—Inserting the Last Device

Figure 14:
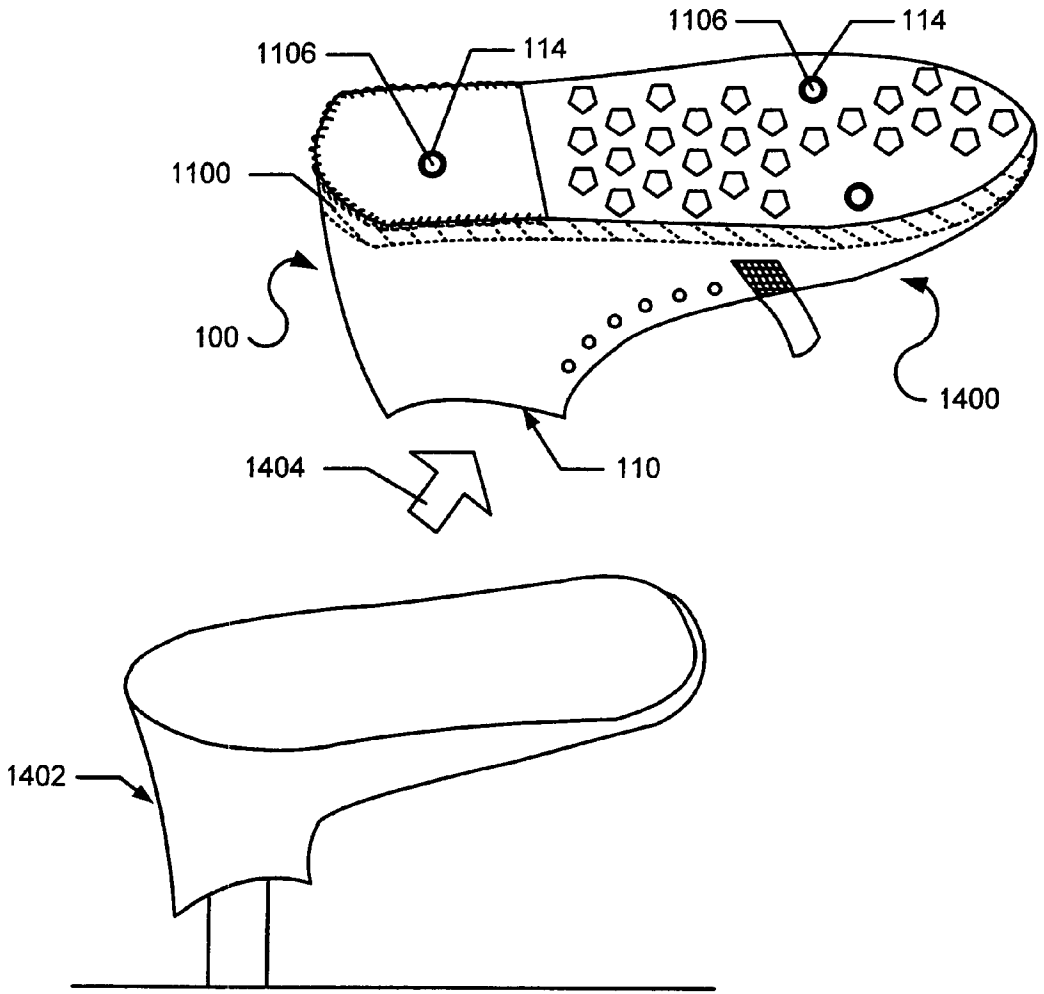
FIG. 14 illustrates an example step of inserting a last device into a midsole and upper member assembly during an example process in accordance with aspects of this invention.

The combined midsole member 1100 and upper member 100 assembly, given reference number 1400 in FIG. 14, now is slid onto a last device 1402 through the foot-receiving opening 110 defined in the upper member 100 (the midsole member 1100 is shown in broken lines in FIG. 14 because it is contained within the upper member 100 and not completely visible from outside it, although the projections 1106 may be visible through the openings 114). This last device insertion step is illustrated in FIG. 14 by arrow 1404. Notably, as illustrated in FIG. 14, the last device 1402 in this step does not include (and does not need) a midsole allowance part as described above in conjunction with FIG. 10, because the midsole and upper member assembly 1400 now includes the permanent midsole 1100 therein. Optionally, the last device 1402 may be the same as the prelast device 1000 used in the steps illustrated in FIGS. 10-12 with a removable midsole allowance part 1002 removed therefrom, or alternatively, it may be a completely different last device without departing from the invention.

Figure 15:
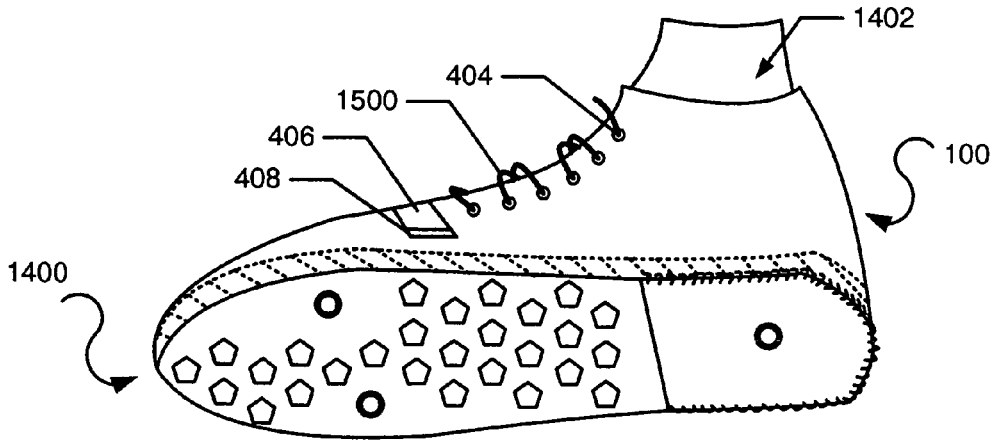
FIG. 15 illustrates an example step of fastening attachment elements to a lasted midsole and upper member assembly during an example process in accordance with aspects of this invention.

Step 15—Loosely Securing the Midsole and Upper Member Assembly to the Last Device Once on the last device 1402, the midsole and upper member assembly 1400 may be secured thereto, optionally in a somewhat loose fashion, using the securing element(s) that will be present in the finished piece of footwear. This securing step helps maintain the midsole and upper member assembly 1400 on the last device 1402 and helps to hold the assembly 1400 in place on the last device 1402. In the illustrated example, as shown in FIG. 15, a shoe lace 1500 is fastened through the eyelets 404 of the upper member 100 and optionally tied in a conventional manner.

Other attachment devices also may be engaged during this step. For example, as shown in the example of FIG. 15, the closure flap 406 may be moved to engage the closure element 408 mounted on and/or integrally formed as part of the upper member 100. As noted above, the closure flap 406 and closure element 408 may engage one another in any suitable or desired manner without departing from the invention, for example, using snaps, hooks, hook-and-loop type fasteners, hook-and-eyelet type fasteners, adhesives, buckles, etc.

Step 16—Passing Through a Heating Device

Figure 16:
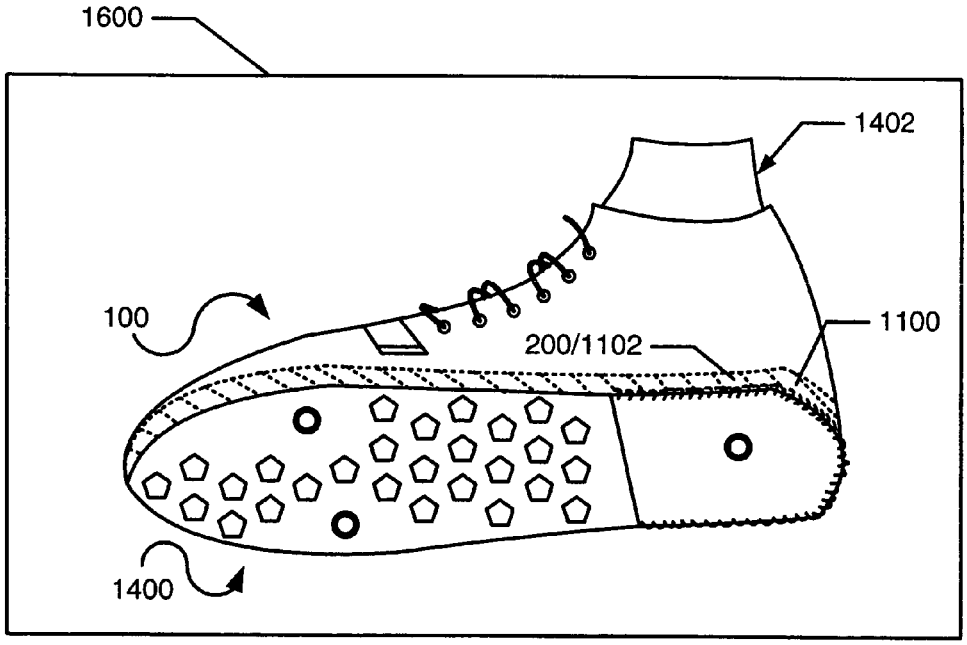
FIG. 16 illustrates an example midsole and upper member assembly heating step in an example process in accordance with aspects of this invention.

The combined midsole and upper member assembly 1400, attached to the last device 1402, now is heated, e.g., by placing the assembly 1400 in a heating device 1600 as shown in FIG. 16. Any suitable or desired heating device 1600 can be used without departing from the invention, such as a heat tunnel, an oven, etc. Additionally, this heating device 1600 may be the same as or different from the heating device 300 described above in conjunction with FIG. 3 without departing from the invention. Because the assembly 1400 previously was cooled, this heating step helps allow the assembly 1400 to mold into its final desired form. For example, the heating reactivates the cement materials 200 and 1102 between the midsole member 1100 and the upper member 100 and firmly sets and bonds these components together. Moreover, the heating step can help expand the cooled midsole component 1100, producing a tighter, more secure fit within the upper member 100. The heating process, in at least some instances, also helps the upper member 100 and the midsole member 1100 take final shape on the last device 1402.

Of course, any suitable or desired heating conditions may be used without departing from the invention, depending, for example, on the type of materials used in the various components, the contact cement type, the ambient conditions, and the like. In the process described in conjunction with the attached figures, the midsole and upper member assembly 1400 may be heated at about 80° C. to 90° C. for about 3 to 4 minutes.

Step 17—Deep Well Pressing

Figure 17:
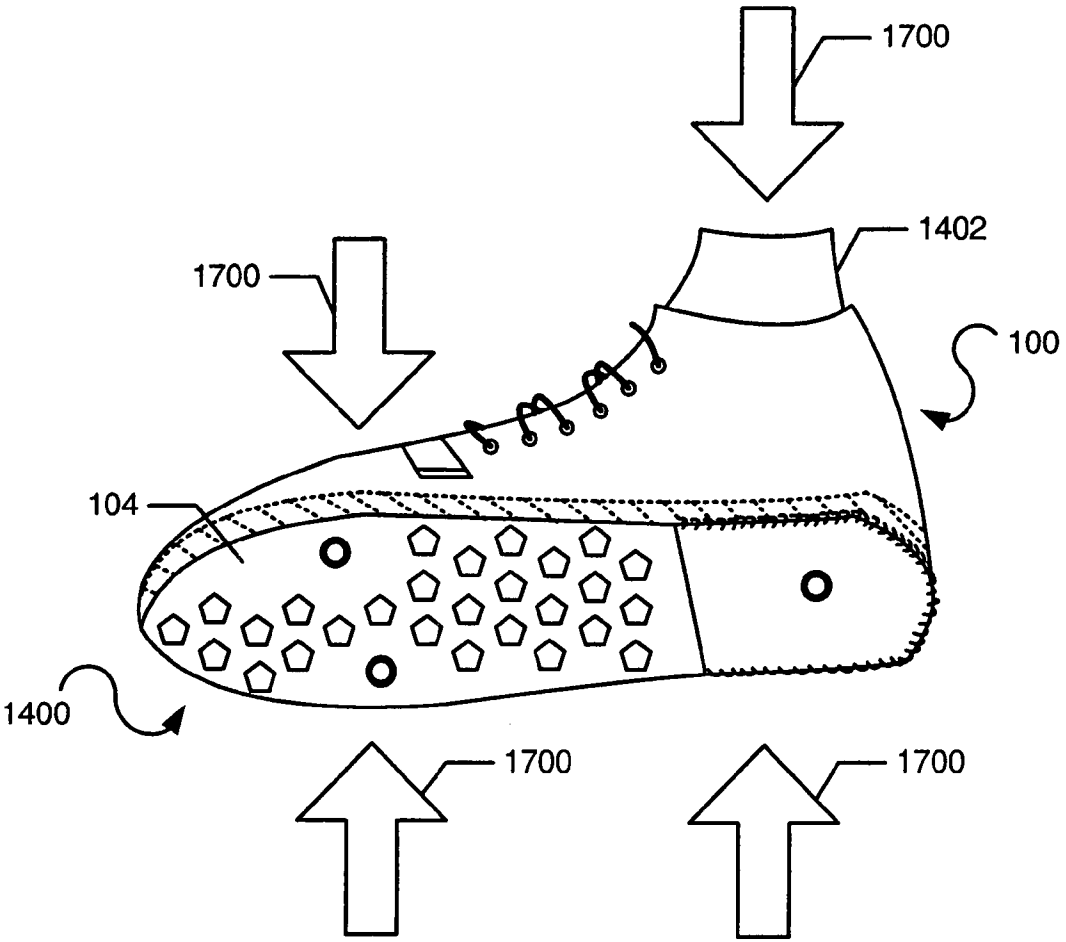
FIG. 17 illustrates an example pressing step during an example process in accordance with aspects of this invention.

The heated midsole and upper member assembly 1400, including the incorporated last device 1402, then may be subjected to a deep well pressing step, e.g., in a conventional manner known to those skilled in the art. This pressing step generally is illustrated in FIG. 17 by arrows 1700. One or more molds or forms (not shown) provided along and/or at least partially around the base member 104 and/or the upper member 100 (e.g., along the bottom of the press device) hold the midsole and upper member assembly 1400 in place, and the last device 1402 holds the upper member 100 and midsole 1100 at their desired locations and in their desired shapes. High pressure, along with the contact cement 200 and 1102, are used to tightly press (and thereby fix) the midsole 1100 to the upper member 100. Optionally, this pressing step may be performed under any desired type of heating or cooling conditions.

Any desired or suitable pressing conditions may be used without departing from the invention. For example, a pressure of at least 10 kg/cm$^2$ for at least five seconds, optionally under heating conditions may be used. In the illustrated procedure, a pressing force of 30-35 kg/cm$^2$ is applied for 12-15 seconds under ambient temperature conditions (although the midsole and upper member assembly 1400 may remain in at least a somewhat heated condition from the previous heating step).

Final Steps

Figure 18:
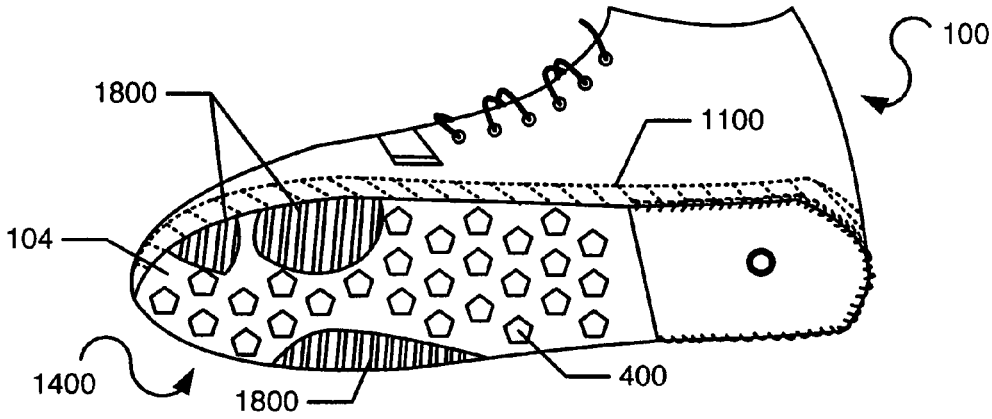
FIG. 18 illustrates an example outsole member attachment step during an example process in accordance with aspects of this invention.

Various additional processing steps may be applied without departing from the invention. For example, at some time during the process, the last device 1402 may be removed from the midsole and upper member assembly 1400. Additionally, as shown in FIG. 18, one or more outsole members 1800 may be applied to the base member 104 of the upper member 100 such that at least a portion of the base member 104 is sandwiched between the midsole 1100 and the outsole member 1800. In this example of a footwear structure in accordance with the invention, a portion of the upper member 100 (e.g., some of the base member 104) will function as a portion of the outsole for the finished piece of footwear. Additional outsole members 1800, for example, elements made of tough, wear-resistant materials, may be provided on at least some portion of the base member 104 to improve and/or otherwise change the wear and/or traction characteristics of the overall piece of footwear. For example, the outsole members 1800 may be provided in areas that typically receive heavy and/or uneven wear. These outsole members 1800 may have treads or traction elements, e.g., either the same as or different from the traction elements 400 provided on the base member 104, if any.

If desired, however, as may be the case in other potential examples of footwear products in accordance with this invention, one or more outsole members 1800 could substantially or entirely cover the base member 104 of the upper member 100 without departing from the invention. In the illustrated example, outsole members 1800 also cover (and optionally seal) the openings 114 in the base member 104 that receive the projections 1106 of the midsole 1100, as described above (see, for example, FIGS. 13 and 14).

The outsole member(s) 1800 may be applied to the midsole and upper member assembly 1400 in any desired manner without departing from the invention, including in conventional manners known in the art. For example, the outsole member(s) may be applied to all or a portion of the base member 104 and/or to other portions of the upper member 100 via primer, contact cement, other adhesives, stitching, via other mechanical connections, and/or in other conventional manners known to those skilled in the art.

In at least some example structures and processes according to this invention, at least one of the outsole member(s) 1800 further may include a heel member that functions as part of the outsole for the piece of footwear. Optionally, if desired, an entire outsole and heel member assembly may be attached to the midsole and upper member assembly 1400 (e.g., to the base member 104) as an integral unit.

Figure 19:
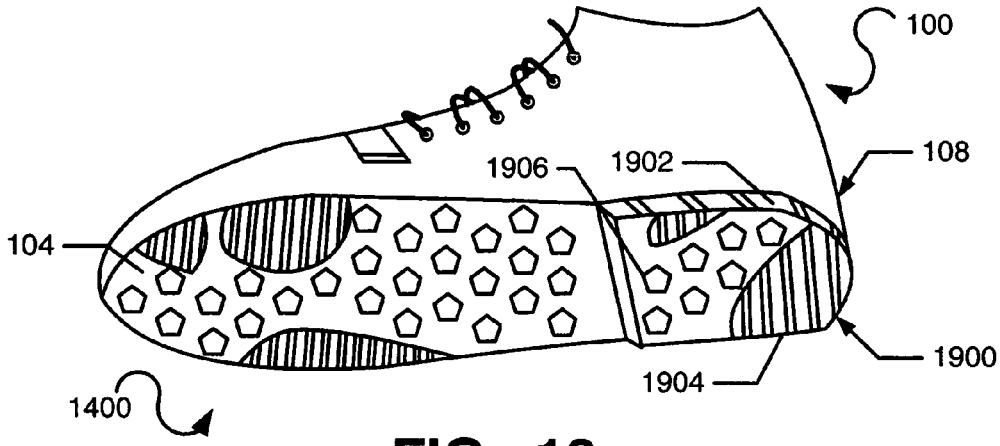
FIG. 19 illustrates an example heel unit attachment step during an example process in accordance with this invention.

As still another example, as illustrated in FIG. 19, a separate heel member 1900 (e.g., a heel cage) may be attached at the heel area 108 of the upper member 100 on the base 104. Optionally, the heel member 1900 may include one or more open recesses and/or air bladders (generally represented at open space 1902 in the heel member 1900 structure), e.g., to help reduce the weight of the overall footwear product. Like the outsole member(s) 1800 described above, the heel member 1900 may be attached to the base member 104 and/or to another portion of the upper member 100 in any suitable or desired manner without departing from this invention, such as via primer, contact cement, other adhesives, stitching, other mechanical connections, and/or in other conventional manners known to those skilled in the art. In this illustrated example, the heel member 1900 covers (and optionally seals) an opening 114 that receives one of the midsole projections 1106, as described above.

Of course, the heel member 1900 may be of any suitable or desired design and construction without departing from the invention. For example, as illustrated in FIG. 19, the heel member 1900 may include outsole member portions 1904 (e.g., made of tough, wear-resistant materials) and/or traction elements 1906 similar to those provided on the base member 104, as illustrated in FIG. 18. Of course, the various traction elements 1906 and/or outsole members 1904, if any, on the heel member 1900 may differ in structure, materials, and the like from those provided as part of the remainder of the footwear structure without departing from the invention.

As described above, the heel members 1900 and/or outsole members 1800 may be attached to an exterior surface of the upper member 100 such that the upper member 100 (and particularly the base portion 104 of the upper member 100) is sandwiched between the midsole and the heel member and/or the outsole member 1800. The major surface of the midsole faces major surfaces of the heel member 1900 and/or the outsole members 1800 with an intervening exterior surface 104 of the upper member 100 sandwiched therebetween. In this manner, the heel members 1900 and/or outsole members 1800 extend over and cover at least some portions of the exterior surface of the upper members 100 (e.g., the base member 104 surface of the upper member 100).

Aspects of the invention also relate to the final footwear products, as well as to the various intermediate products and assemblies used in making the footwear products, such as the various structures and assemblies produced during the various individual process steps described above in conjunction with FIGS. 1-19. Structures in accordance with the invention, including the various intermediate structures described above, may be produced by any method without departing from the invention. At least some footwear structures in accordance with the invention may have a very lightweight construction, particularly those having one or more of the following features: (a) at least a portion of the outsole formed from the upper member structure (optionally with traction elements attached thereto or attached to the midsole and extending through the base member of the upper member); (b) at least a portion of the outsole formed from outsole members attached to the upper member, e.g., at locations of heavy wear; and (c) a lightweight heel member attached to the upper member, e.g., a heel member including one or more air pockets or air bladders. Such products may be particularly useful for athletic shoes, sport-specific shoes, and the like.

While specific processes and structures in accordance with the invention are described in detail above, those skilled in the art will appreciate that these disclosures merely constitute examples of processes and structures in accordance with this invention. The skilled artisan will appreciate that the various structures, materials, process steps, process conditions, and the like may vary widely without departing from the invention. Additionally, the skilled artisan will appreciate that variations in the process steps also may occur without departing from the invention. For example, specific steps described above may be omitted, changed, changed in order, and the like without departing from the invention. Also, additional steps may be included between the various steps described above without departing from aspects of this invention.

D. Conclusion

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. A method of manufacturing footwear, comprising:

applying a first cement material to at least a portion of an interior surface of an interior chamber of the upper member;

applying a second cement material to at least a portion of a midsole that will contact the upper member when the midsole is included in the upper member;

cooling at least one of the upper member or the midsole to a sufficient extent so that the midsole and upper member will move with respect to one another despite the presence of the first and second cement materials; and placing the midsole in the interior chamber of the upper member in a manner such that at least some of the cement-containing portion of the midsole contacts and moves with respect to at least some of the upper member and at least some of the cement-containing portion of the interior surface of the interior chamber of the upper member contacts and moves with respect to at least some of the midsole.

2. A method of manufacturing footwear according to claim 1, further comprising:

after placing the midsole in the interior chamber of the upper member, heating the midsole and the upper member.

3. A method of manufacturing footwear according to claim 1, wherein the midsole is placed in the interior chamber of the upper member through a foot-receiving opening defined in the upper member.

4. A method of manufacturing footwear according to claim 1, further comprising:

attaching an outsole member to at least a portion of the upper member.

5. A method of manufacturing footwear according to claim 4, further comprising:

attaching a heel unit to the upper member.

6. A piece of footwear made by the method of claim 5.

7. A piece of footwear made by the method of claim 4.

8. A method of manufacturing footwear according to claim 1, further comprising:

attaching a heel unit to the upper member.

9. A method of manufacturing footwear according to claim 1, wherein the first cement material is the same as the second cement material.

10. A method of manufacturing footwear according to claim 1, further comprising:

fitting the midsole into the upper member in a predetermined orientation.

11. A method of manufacturing footwear according to claim 10, wherein the fitting includes aligning at least one projection provided on the midsole with a projection-receiving recess or opening defined in the upper member.

12. An upper member and midsole assembly made by the method of claim 1.

13. A method of manufacturing footwear, comprising:

providing an upper member, wherein the upper member includes a foot-receiving opening defined therein providing access to an interior chamber defined by the upper member;

placing a prelast member through the opening into the interior chamber, wherein the prelast member includes a midsole allowance part;

removing the prelast member and the midsole allowance part from the upper member;

applying a cement material to at least a portion of an interior surface of the interior chamber; and placing a midsole in the interior chamber of the upper member through the opening; and cooling at least one of the upper member or the midsole prior to placing the midsole in the upper member.

14. A method of manufacturing footwear according to claim 13, further comprising:

applying a first cement material to at least a portion of the midsole before placing the midsole in the interior chamber.

15. A method of manufacturing footwear according to claim 14, wherein at least some of the cement-containing portion of the midsole will contact at least some of the upper member and at least some of the cement-containing portion of the interior surface of the interior chamber of the upper member will contact at least some of the midsole when the midsole is placed in the upper member.

16. A method of manufacturing footwear according to claim 15, wherein the at least one of the upper member or the midsole is cooled to a sufficient extent so that the cement-containing portion of the midsole will move with respect to the upper member and so that the cement-containing portion of the interior surface of the interior chamber of the upper member will move with respect to the midsole.

17. A method of manufacturing footwear according to claim 16, further comprising:

after placing the midsole in the interior chamber of the upper member, heating the midsole and the upper member.

18. A method of manufacturing footwear according to claim 13, further comprising:

attaching an outsole member to at least a portion of the upper member.

19. A method of manufacturing footwear according to claim 18, further comprising:

attaching a heel unit to the upper member.

20. A piece of footwear made by the method of claim 19.

21. A piece of footwear made by the method of claim 18.

22. A method of manufacturing footwear according to claim 13, further comprising:

attaching a heel unit to the upper member.

23. A method of manufacturing footwear according to claim 13, further comprising:

placing a last member through the opening into the interior chamber of the upper member after the midsole is placed in the upper member.

24. A method of manufacturing footwear according to claim 23, further comprising:

heating the midsole, upper member, and last member.

25. A method of manufacturing footwear according to claim 24, further comprising:

pressing the midsole, upper member, and last member together.

26. A method of manufacturing footwear according to claim 23, further comprising:

pressing the midsole, upper member, and last member together.

27. A method of manufacturing footwear according to claim 13, further comprising:

fitting the midsole into the upper member at a predetermined orientation.

28. A method of manufacturing footwear according to claim 27, wherein the fitting includes aligning at least one projection provided on the midsole with a projection-receiving recess or opening defined in the upper member.

29. A method of manufacturing footwear according to claim 13, further comprising:

before placing the midsole in the interior chamber of the upper member, applying a cement material to at least one member selected from the group consisting of: at least a portion of the midsole and at least a portion of the upper member.

30. A method of manufacturing footwear according to claim 29, wherein the at least one of the upper member or the midsole is cooled to a sufficient extent so that the midsole will move with respect to the upper member when the midsole is placed in the upper member despite the presence of the cement material.

31. A method of manufacturing footwear according to claim 30, further comprising:

after placing the midsole in the interior chamber of the upper member, heating the midsole and the upper member.

32. A method of manufacturing footwear according to claim 31, further comprising:

pressing the midsole and upper member together.

33. An upper member and midsole assembly made by the method of claim 13.

34. A method of manufacturing footwear, comprising:

applying a cement material to at least one member selected from the group consisting of: at least a portion of an interior surface of an interior chamber of an upper member and at least a portion of a midsole that will contact the interior surface of the interior chamber of the upper member when the midsole is included in the upper member;

cooling at least one of the upper member or the midsole to a sufficient extent so that the midsole and upper member will move with respect to one another despite the presence of the cement material; and placing the midsole in the interior chamber of the upper member in a manner such that at least some of the midsole contacts and moves with respect to at least some of the upper member despite the presence of the cement material.

35. A method of manufacturing footwear according to claim 34, further comprising:

after placing the midsole in the interior chamber of the upper member, heating the midsole and the upper member.

36. A method of manufacturing footwear according to claim 34, wherein the midsole is placed in the interior chamber of the upper member through a foot-receiving opening defined in the upper member.

37. A method of manufacturing footwear according to claim 34, further comprising:

attaching an outsole member to at least a portion of the upper member.

38. A method of manufacturing footwear according to claim 37, further comprising:

attaching a heel unit to the upper member.

39. A method of manufacturing footwear according to claim 34, further comprising:

attaching a heel unit to the upper member.

40. A method of manufacturing footwear according to claim 34, further comprising:

fitting the midsole into the upper member at a predetermined orientation.

41. A method of manufacturing footwear according to claim 40, wherein the fitting includes aligning at least one projection provided on the midsole with a projection-receiving recess or opening defined in the upper member.

42. An upper member and midsole assembly made by the method of claim 34.

* * * * *

UNITED STATES PATENT AND TRADEMARK OFFICE

CERTIFICATE OF CORRECTION

PATENT NO. : 7,634,831 B2
APPLICATION NO. : 11/142674
DATED : December 22, 2009
INVENTOR(S) : Stockbridge et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 886 days.

Signed and Sealed this

Ninth Day of November, 2010

David J. Kappos

David J. Kappos
*Director of the United States Patent and Trademark Office*